US006298527B1

(12) United States Patent
Fildan et al.

(10) Patent No.: US 6,298,527 B1
(45) Date of Patent: Oct. 9, 2001

(54) BUTTON FASTENER

(75) Inventors: Gerhard Fildan, Vienna; Karl Wanzenböck, Leobersdorf, both of (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/578,060

(22) Filed: May 24, 2000

(51) Int. Cl.[7] ..... A41C 3/00; A41C 3/05; A41C 3/12

(52) U.S. Cl. ..... 24/689; 450/82; 450/86; 450/88; 24/687; 24/692; 24/578.11

(58) Field of Search ..... 24/265 EC, 265 BC, 24/590, 588, 662, 663, 689, 687, 692, 114.4, 114.6, 578.11; 450/82, 86, 88; 2/265, 78.1, 310, 326–331

(56) References Cited

U.S. PATENT DOCUMENTS

| | | | | |
|---|---|---|---|---|
| 2,423,046 | * | 6/1947 | Patterson | 450/86 |
| 2,782,418 | * | 2/1957 | Garson | 450/86 |
| 2,817,089 | * | 12/1957 | Oelbaum | 450/88 X |
| 3,489,153 | * | 1/1970 | Gaisser | 450/88 |
| 3,685,105 | * | 8/1972 | Carlile et al. | 24/689 |
| 3,925,860 | * | 12/1975 | Furuya | 24/687 |
| 4,296,533 | * | 10/1981 | Doerter | 24/689 X |
| 4,761,863 | * | 8/1988 | Sugihara | 24/692 |
| 6,186,861 | * | 2/2001 | Flaherty | 450/88 X |

* cited by examiner

*Primary Examiner*—Robert J. Sandy
(74) *Attorney, Agent, or Firm*—Herbert Dubno

(57) ABSTRACT

A garment fastener, especially for brassieres, with a press-button action and configuration, utilizes a pair of circular members welded to the garment and through which the fabric is visible and a circular member attached to the strap and forming a press connection with either of the two circular members attached to the fabric.

20 Claims, 6 Drawing Sheets

FIG. 2
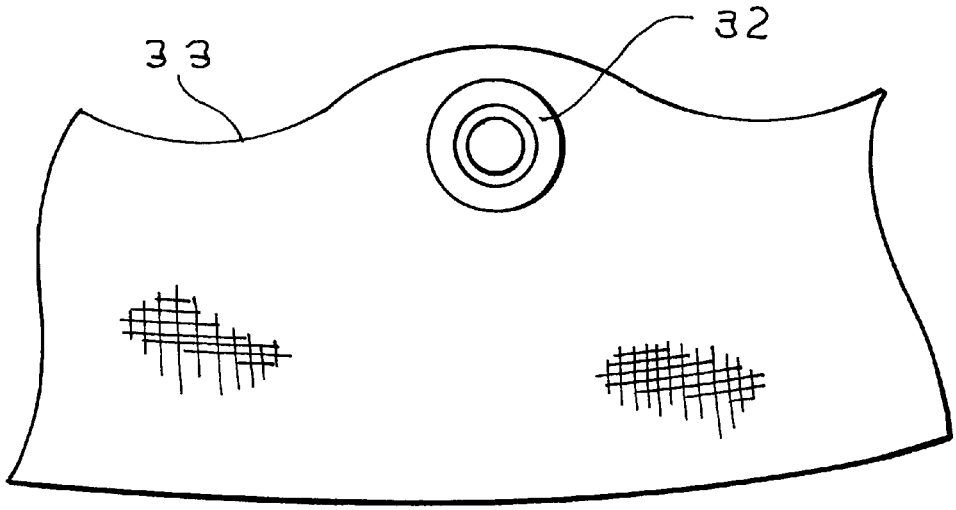
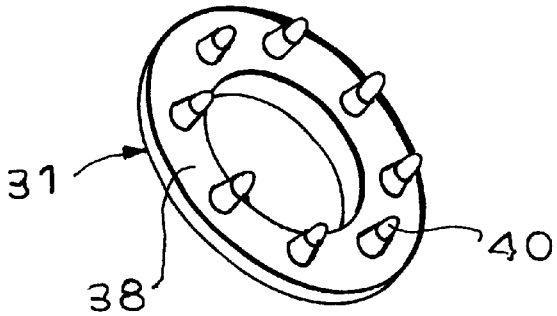
FIG. 3
FIG. 4
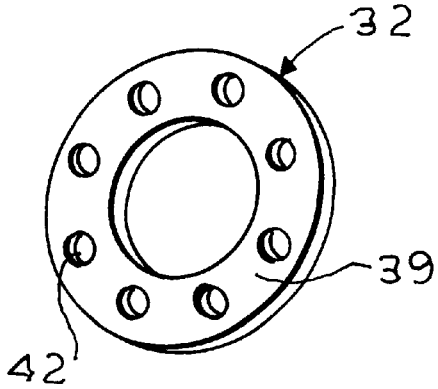

FIG. 5
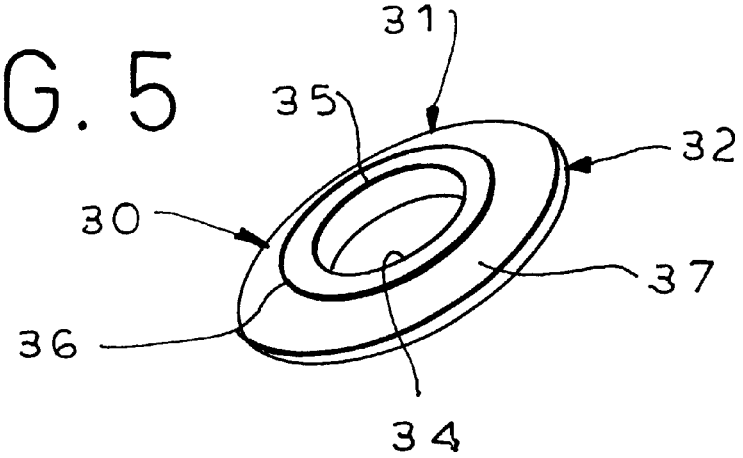
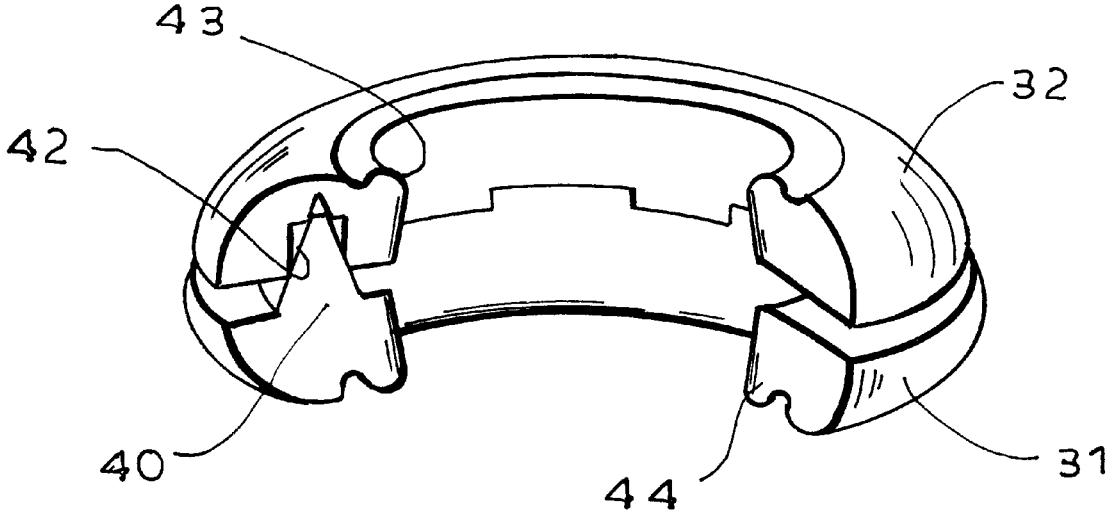
FIG. 6

BUTTON FASTENER

FIELD OF THE INVENTION

Our present invention relates to a button fastener, especially for brassieres and, more particularly, to a fastener which can be used to attach a strap or the like to a garment, such as a brassiere, utilizing a press-fit between male and female members.

BACKGROUND OF THE INVENTION

While a variety of fasteners have been used heretofore to attach, for example, the strap of a brassiere to the body thereof, there is a continuing desire for improvement in this field. Hook and loop fasteners, for example, have aesthetic disadvantages, while eyelet type fasteners may require stitching of fabric pieces or fastener parts to the garment. Most fasteners provided heretofore have been relatively complex, time-consuming in application to the garment or unsatisfactory from the point of view of laundering and manipulation by the user.

OBJECTS OF THE INVENTION

It is, therefore, the principal object of the present invention to provide a garment fastener, especially between a strap and the body of a brassiere, which is easily applied to the fabric, can be connected and disconnected easily, is capable of withstanding repeated laundering and poses no danger to other delicate garments in the wash, and is aesthetic in appearance in all stages.

Another object of the invention is to provide a fastener which can have a part attached to a garment body, for example, that of a strapless brassiere, so that another part, for example, a strap, can be applied as need arises.

It is also an object of this invention to provide a fastener for the purposes described which can be used as a decorative element on the garment.

Still another object of the invention is to provide a garment with improved aesthetic and improved reliability and ease of functioning of these garment fasteners.

Yet a further object is to eliminate drawbacks of earlier garment fasteners, especially for brassieres.

It is an object of this invention, as well, to provide an improved fastener for a reversible garment, especially an undergarment and most particularly a brassiere, which is compatible with the difference in colors of the sides of that garment.

A related object is to provide an improved reversible garment which can be fabricated economically and more efficiently than earlier garments, utilizing a button-type fastener.

SUMMARY OF THE INVENTION

These objects and others which will become apparent hereinafter are attained, in accordance with the invention, in a fastener for two parts of a garment, e.g. a strap and a brassiere body, and having respective fastener parts attached to the two parts of the garment to be joined together. According to the invention, one of these parts is a ring which is formed with an opening and is composed of two sections, one on each side of the fabric piece carrying the fastener part and welded together through the fabric so that the fabric is exposed through the opening. The other fastener part forms a press button with the first fastener part and preferably has a formation complementary to the formation on either of the two sections of the ring and can be press-fitted onto it. The formations are respectively a male formation and a female formation. The female formation can be an inwardly-extending overhang surrounding the opening in the respective ring section while the male formation can be a generally cylindrical collar boss or rib having an outward bulge engageable behind the overhang.

The outer configuration of the male member can correspond to that of the female members so that when the two parts of the fastener are joined together, they appear identical from front and back. The male member can engage in the female fastener part at either one of its sections, i.e. on one side of the fabric or the other and in that case the fastener may be reversible and the garment carrying the fastener can be reversible. The fact that the fabric of the garment is exposed through the openings in both the male and female fastener parts has been found to contribute to the overall aesthetics of the fastener which has a press button configuration and in which the female fastener part can form a decorative element for the body of the garment even if no strap is applied.

According to a feature of the invention, one of the sections of the female part of the fastener can be provided with a plurality of spaced-apart pins which are pointed and can pierce the fabric when the two parts of the female fastener are pressed together and joined by welding to one another and to the fabric. The other sections of the female fastener parts may have a plurality of recesses or depressions dimensioned to receive the projections.

The male fastener part can be connected to the strap by a pair of shield-shaped plates which straddle the strap and are welded thereto. It has been found to be advantageous to form the male fastener part with a laterally-projecting lug which is connected to the aforementioned plates. The lug can be provided with pins engageable in holes in the plates or holes can be provided in the lug through which pins of one or both of the plates can extend. For aesthetic reasons, it is desirable to have the pins connecting the plates together and/or to the lug project from a side of one of the plates. In this case, one of the plates can be provided with the pins which pass through holes in the lug and in the other plate.

The invention also encompasses the garment provided with such a fastener, especially a brassiere. In that case, a body of the brassiere is provided with the female fastener and the male fastener can engage in this female fastener from either side and can be carried by the strap.

The fastener of the invention has been found to be particularly effective with reversible garments, especially reversible undergarments such as brassieres. A brassiere, according to the invention, can be fabricated from molded cups entirely by a welding process, i.e. without stitched seams, and such that the fabrics on the opposite sides of the brassiere have different colors so that either of these colors or fabrics may be the outer fabric and the other the inner fabric of the brassiere, depending upon how the garment is reversed. According to the present invention, one of the annuluses of the female fastener may be of one color while the other annulus is of another color to match the fabric or side of the brassiere to which the respective annulus is welded.

Since the male fastener part is attached to the strap by welding and the female fastener part has its annuluses or rings also attached by welding, not only is the garment itself fabricated by a welding process free from stitching but the reversible fastener can be applied also entirely by welding operations. Naturally, the opposite sides of the male fastener part may be of different colors corresponding to the colors of the annuluses or rings of the female fastener part so that the male fastener part, upon reversible of the garment, need only be turned over to provide a match between the visible portions of the two fastener parts.

BRIEF DESCRIPTION OF THE DRAWING

The above and other objects, features, and advantages will become more readily apparent from the following description, reference being made to the accompanying drawing in which:

FIG. 2 is an elevational view showing one side of the female part of this fastener applied to a fabric;

FIG. 3 is a perspective view of one section of the female fastener part;

FIG. 4 is a perspective view of the other section;

FIG. 5 is a perspective view of the two sections joined together, albeit without the fabric between them;

FIG. 6 is a perspective view broken away showing the two sections joined and without the fabric between them;

SPECIFIC DESCRIPTION

Figure 1:
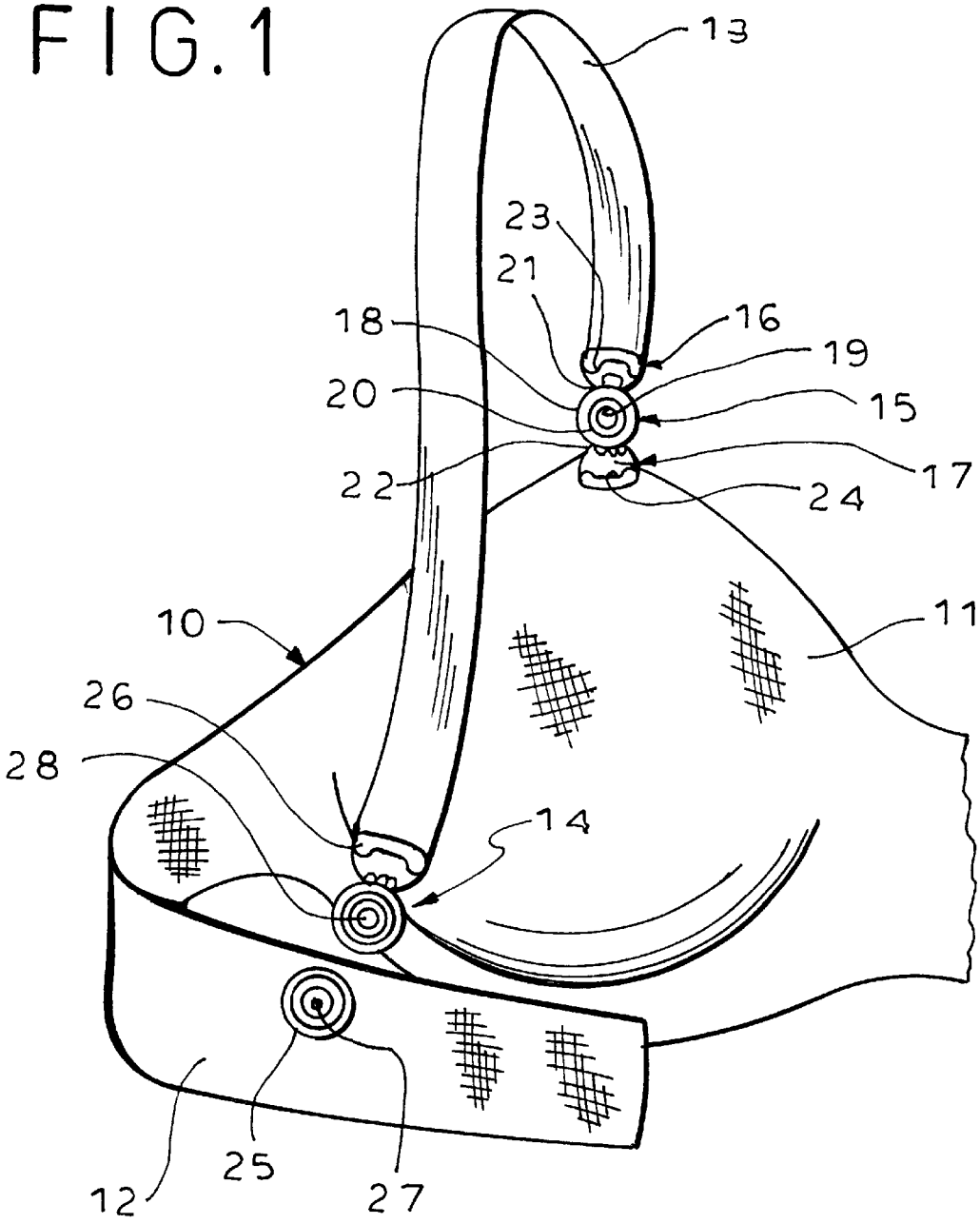
FIG. 1 is a perspective view of a brassiere provided with a fastener according to the invention.

The principles of the invention will be apparent from FIG. 1 which shows half of a brassiere 10 having a cup 11 and a back strap 12. A shoulder strap 13 can be connected to the brassiere by a pair of press-button fasteners represented at 14 and 15, respectively.

The fastener 15 comprises male and female members 16 and 17 attached to the strap 13 and to the brassiere body 10, respectively, and interconnected at a button 18 of circular shape. The cylindrical boss 19 of the male member 16 can be seen within the hole formed by the ring 20 of the female member. The male and female members are both carried via lugs 21 and 22 by pairs of shield-shaped plates 23 and 24, welded to the strap 13 and to the cup fabric, respectively. A press-button fastener of this type is described in the copending application Ser. No. 29/120,109 filed Mar. 14, 2000.

The press-button fastener of the present invention differs from that shown at 15 in that the female member is formed from two ring-shaped sections, one of which is visible at 25 in FIG. 1. A similarly-shaped circular ring fastener part is provided on the opposite side of the strap 12 of the body of the brassiere and is not visible in FIG. 1. The male member 26, however, is engageable in the opening on either of these two annuluses and thus can be affixed to the female fastener part on either side of the strap 12. In either case, a fabric portion 27 is visible through the opening of the female member and will be visible through the opening 28 of the male member when the latter is pressed onto the female member.

Figure 7:
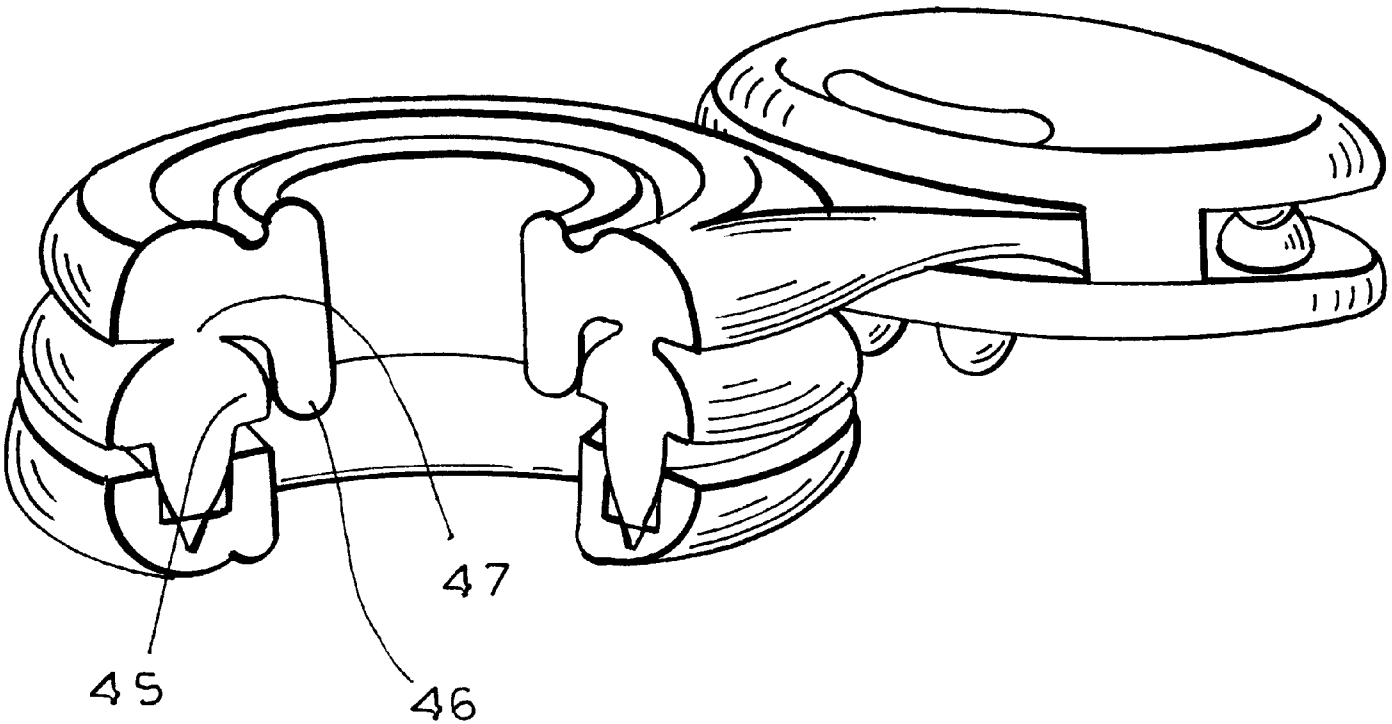
FIG. 7 is a perspective view partially broken away showing the fastener with the male and female parts joined but again without the fabric between the two sections of the female parts.

The female member of the fastener is identified at 30 in FIG. 5 and is formed as two halves or sections 31 and 32 straddling the fabric 33 of the garment. The external appearances of the two halves are identical and thus each has an opening 34 surrounded by a thin ridge 35 separated by a groove 36 from a thicker bead 37. The ring half 31 has been shown in FIG. 3 and the complementary half 32 has been illustrated in FIG. 4. From FIGS. 3 and 4 it will be apparent that each of the female fastener sections has a flat surface 38 or 39 adapted to lie against the fabric 33 while the section 31 has angularly-equispaced pointed pins 40 adapted to pierce the fabric and engage in corresponding recesses 42 formed in the member 32. The two sections are joined together as shown in FIG. 6 with the projections 40 in the recesses 42 and the sections thermally or ultrasonically welded together and to the fabric 33 sandwiched between them but not visible in FIG. 5, 6 or 7.

Figure 8:
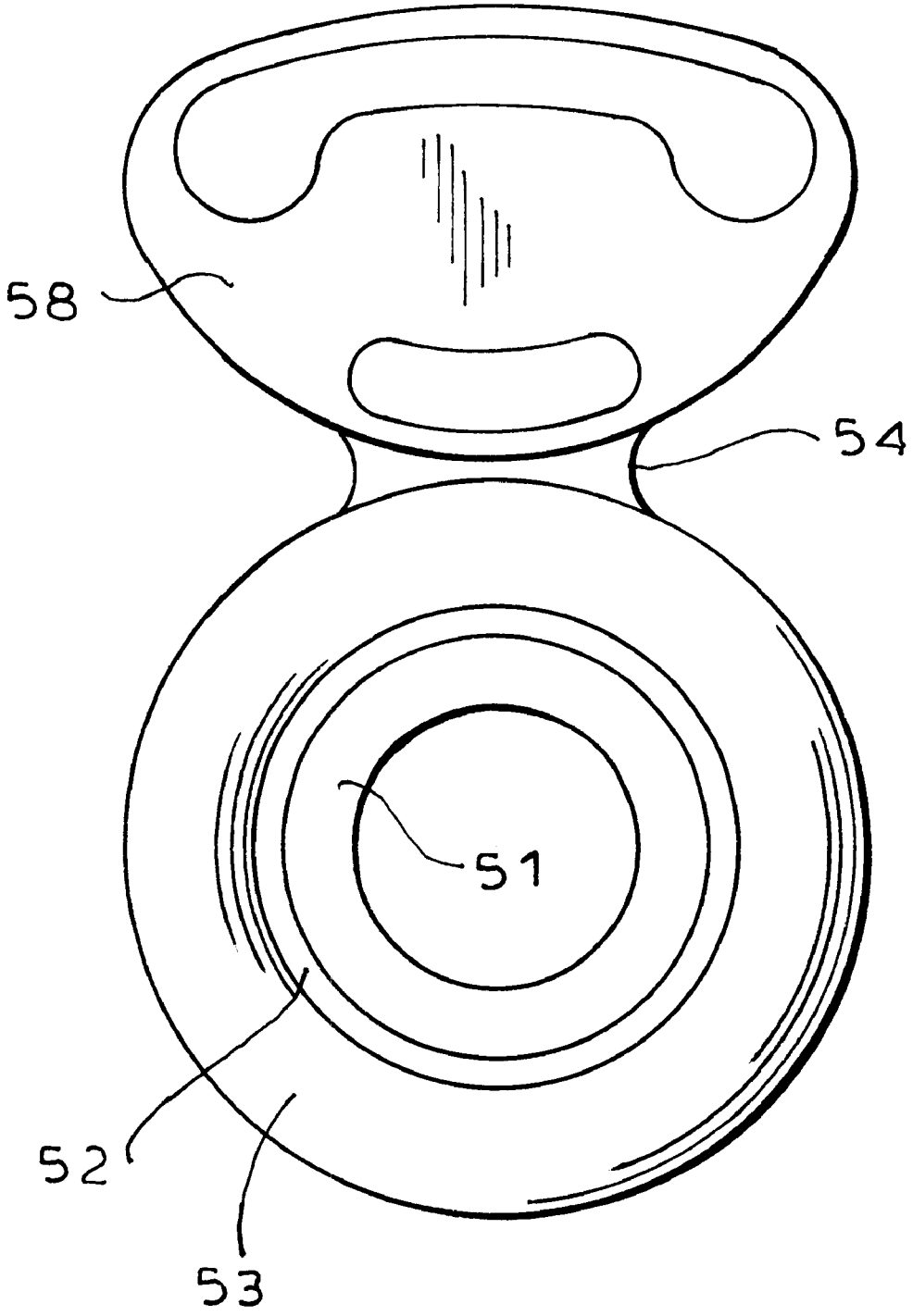
FIG. 8 is an enlarged elevational view of the male portion of the fastener seen from one side.
Figure 9:
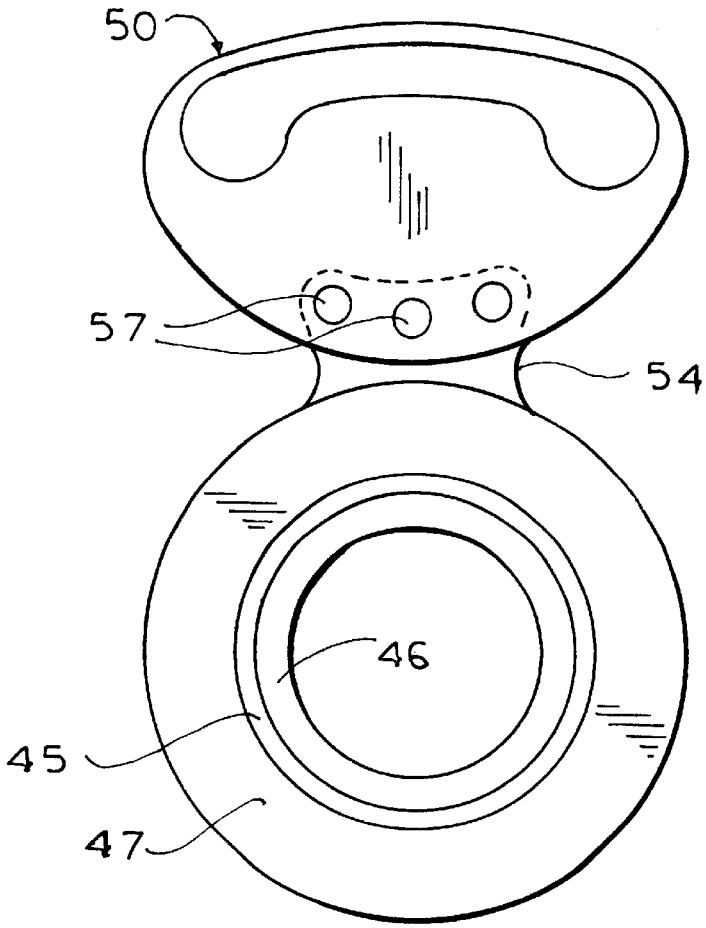
FIG. 9 is a view similar to FIG. 8 showing the male fastener part as seen from the opposite side.

As is also apparent from FIG. 6, the narrow ribs 35 of the two sections form overhanging edges 43 and 44 which engage behind a bulge 45 in the cylindrical rib 46 projecting from the flat surface 47 of the male member of the fastener. The side of the male member 50 of the fastener from which the cylindrical projection 46 juts is visible in FIG. 9. The opposite side is seen in FIG. 8 and has a narrow rib 51 separated by a groove 52 from a wider bead 53 similar to that of the sections 31 and 32 shown in FIGS. 3–7 so that the appearance remains generally the same whether the male and female members are connected or the female member is seen alone. In any case, the fabric piece 27 can be viewed through the openings in the male and female members. The male member is in addition formed with a lateral lug 54 which can have holes receiving pins 57 of a plate 58 projecting through these holes and through holes in another shield-shaped plate 59.

Figure 10:
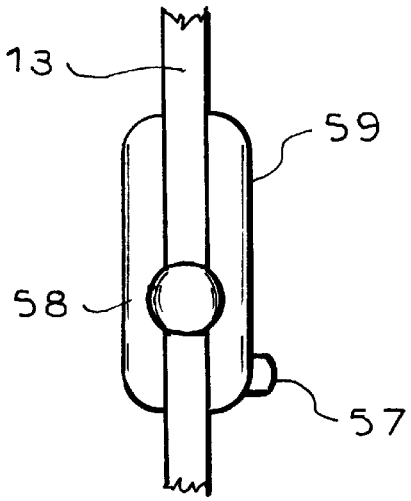
FIG. 10 is a side elevational view of the plates affixing the male fastener part to the strap.
Figure 11:
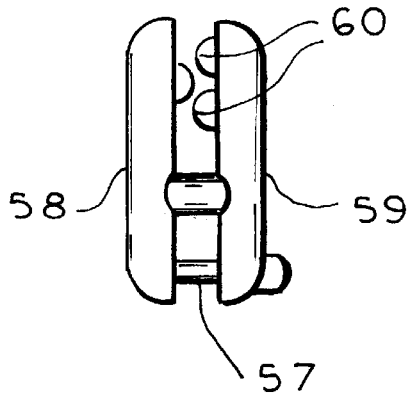
FIG. 11 is a side elevational view of the two plates connected together but without the strap or the lug of the male fastener part.

The pins 57 are visible in FIGS. 10 and 11 as well and the plates 58 and 59 can be seen to have projections 60 which grip the strap 13 when the latter is sandwiched between the plates and is welded thereto. Of course the plates 58 and 59 are not only welded to the strap 13 but to one another and to the lug 54 via the pins 57.

The welding here as well can be ultrasonic or thermal or a combination of the two.

The parts of the fastener can be injection molded from synthetic resin material and the plates 58 and 59 can have a different color from that of the male fastener portion and/or the female fastener portion and, while all of the parts can be of a matte finish, various textures or finishes can be provided.

As will be apparent from FIG. 1, the brassiere body 10 can be fabricated entirely by welding processes, the cups 11 of the brassiere being molded. Advantageously, the opposite sides of the brassiere 10, shown by different shading in FIG. 1, may be of different colors and hence the ring of the female fastener part applied to one side of the garment can be of a different color from the ring applied to the opposite side. The male fastener part may be of different colors on opposite sides as well so that, like the garment, the strap can be reversed to ensure a match between the respective side of the male fastener part and the ring of the female fastener part which it engages. In that case, each of the male and female fastener parts are of two colors to match the two colors of the garment.

We claim:

1. A garment fastener comprising:

a first fastener part secured to fabric of a garment and comprising a pair of annular fastener sections on opposite sides of the fabric and through which the fabric is visible on each side;

a second fastener part having an annular member engageable with either of said sections and through which the fabric is visible from the side on which said second fastener part is engaged with the respective section; and complementary male and female formations on said second fastener part and on said sections, respectively, for releasable engagement by press-button action to engage the second fastener part with the first fastener part.

2. The garment fastener defined in claim 1 wherein said male and female formations are respectively an annular boss having an outer bulge and an inwardly-extending edge of an opening of the respective part.

3. The garment fastener defined in claim 2 wherein said male formation is on said second fastener part and said sections each have said female portions.

4. The garment fastener defined in claim 3 wherein said sections have identical external configurations.

5. The garment fastener defined in claim 4 wherein said sections and annular member are all circular.

6. The garment fastener defined in claim 1 wherein said fastener sections is provided with a plurality of pins adapted to pierce through said fabric and the other of said fastener sections has respective recesses adapted to receive said pins.

7. The garment fastener defined in claim 6 wherein said sections have flat surfaces engageable with the fabric.

8. The garment fastener defined in claim 1 wherein each of said sections has a narrow rib surrounding a respective opening and is separated by a groove from a wide bead.

9. The garment fastener defined in claim 8 wherein said annular member has the same external configuration as said sections.

10. The garment fastener defined in claim 1 wherein said annular member is provided with means for securing said second fastener part to a strap.

11. The garment fastener defined in claim 10 wherein said means for securing said second fastener part to said strap includes a lug projecting laterally from said annular member and a pair of plates which can be welded to said strap connected to said lug.

12. The garment fastener defined in claim 11 wherein said plates have a shield shape.

13. The garment fastener defined in claim 11 wherein one of said plates has a plurality of pins extending through openings in said lug and holes in the other of said plates.

14. The garment fastener defined in claim 1 wherein said fastener sections are welded to said fabric and to each other and said second fastener part is welded to a strap.

15. A brassiere comprising a brassiere body formed of fabric and having a garment fastener for detachably connecting a strap thereto, said garment fastener comprising a first fastener part secured to the fabric and comprised of a pair of circular fastener sections on opposite sides of the fabric and through which the fabric is visible on each side, said strap being provided with a second fastener part having a circular member engageable with either of said sections and through which the fabric is visible from the side on which said second fastener part is engaged with the respective sections, each of said sections having an edge projecting inwardly around a respective opening, said member having a circular collar engageable in either of the openings of said sections and formed with an outer bulge engageable behind the respective edge.

16. The brassiere defined in claim 15 wherein each of said sections and said member are of identical external configuration.

17. The brassiere defined in claim 16 wherein each of said sections and said member have a narrow ridge surrounding a respective opening through which the fabric is visible and separated by a groove from a wide bead.

18. The brassiere defined in claim 17 wherein said sections has a multiplicity of pins piercing through said fabric and the other of said sections has a multiplicity of recesses respectively receiving said pins, said sections and said fabric being welded together.

19. The brassiere defined in claim 18 wherein said member is provided with a lateral lug, said second fastener part comprising a pair of plates welded to said strap and connected to said lug.

20. The brassiere defined in claim 19 wherein one of said plates has a plurality of pins extending through respective openings in said lugs and into respective holes in the other of said plates.

* * * * *